United States Patent [19]

Gibson et al.

[11] Patent Number: 4,850,062

[45] Date of Patent: Jul. 25, 1989

[54] TOILET SEAT LIFTING AID

[76] Inventors: Phillip R. Gibson, 2927 W. Olive; Ival D. McNutt, 2603 W. Harrison, both of, Springfield, Mo. 65802

[21] Appl. No.: 188,859

[22] Filed: May 2, 1988

[51] Int. Cl.[4] ..... A47K 13/10

[52] U.S. Cl. ..... 4/251; 16/126; 16/110 R; 16/DIG. 24

[58] Field of Search ..... 4/237, 251, 661; 16/110 R, 112, 126; 446/27

[56] References Cited

U.S. PATENT DOCUMENTS 2,236,576 4/1941 Loebner ..... 4/251
3,535,594 10/1970 Meyer ..... 16/126 X
3,545,760 12/1970 Wilson ..... 446/27
4,742,582 5/1988 Giallourakis ..... 4/661 X

*Primary Examiner*—Charles E. Phillips
*Attorney, Agent, or Firm*—James D. Christoff

[57] ABSTRACT

A toilet seat lifting aid includes a circular lifting element which projects outwardly in a horizontal direction laterally away from the seat so that the seat can be raised or lowered without directly touching the same. The lifting element is connected to a support which, in turn, carries a quantity of pressure-sensitive adhesive for quick installation of the lifting element to a peripheral, bottom side portion of the seat. In preferred forms, the lifting element has a smoothly rounded outer edge and is pivotally interconnected with the support for rotation relative to the seat when accidentally brushed against by the user's legs in order to avoid abrasion of the skin.

5 Claims, 1 Drawing Sheet

TOILET SEAT LIFTING AID

BACKGROUND OF THE INVENTION

1. Field of the Invention

This invention relates to a health accessory for toilets, and particularly concerns a toilet seat lifting aid which may be easily secured to the underside of the seat. The lifting aid includes a circular lifting element that is rotatable about its central axis for minimizing abrasive contact with the user's legs.

2. Description of the Prior Art

The cleanliness and sanitation of bathrooms is deemed important in virtually every civilized society. In practice, however, bathroom fixtures and especially toilets quickly become unclean through ordinary use in both private bathrooms and public restrooms. Moreover, it is not reasonable to expect that the toilet will be cleaned after each use.

The toilet seat, for example, is an item that must often be handled from one use to the next. To lift the seat, the user must grasp the side of the seat by inserting his fingers between the bottom of the seat and the top of the bowl so that the hand can make sufficient contact with the underside of the seat for raising the latter to an upright position. In some instances, and particularly in commercial or industrial settings, the hinges of the seat may be somewhat stiff such that a firm grip is necessary to raise the seat.

Unfortunately, there is a well known tendency for liquid waste and moisture to cling and accumulate on the underside of the seat. Moreover, the bottom of the seat as well as adjacent top regions of the bowl may harbor germs and represent a breeding ground for microorganisms that can cause bacterial, viral and other types of infectious disease. Such highly unpleasant and unsanitary conditions, however, are not normally noticed until after the seat has been handled.

It is well known that thorough cleaning of the toilet tank, bowl and seat at frequent intervals can reduce the possibility of disease transmission. However, the underside of the toilet seat is all too often ignored, especially when the bathroom is given only a relatively cursory cleaning. Consequently, a solution to these and other problems would be highly advantageous.

SUMMARY OF THE INVENTION

Our present invention overcomes the above-noted disadvantages by provision of a toilet seat lifting aid that can be readily secured to the underside of the seat. The lifting aid projects laterally outwardly from the seat so that the seat can be easily raised when desired without touching either the seat or the bowl.

In more detail, the lifting aid in accordance with our invention includes a circular, smoothly rounded lifting element that extends outwardly in a horizontal direction from beneath the underside of the toilet seat. The lifting element is connected to a support which, in turn, carries a quantity of pressure-sensitive adhesive initially covered by a protective backing. To install the lifting aid, the backing is peeled away from the adhesive and the support is positioned adjacent a bottom peripheral edge portion of the seat, preferably on either of the sides of the seat to avoid contact with the legs of an individual sitting on the toilet.

In preferred embodiments of the invention, the circular lifting element is pivotally coupled to the support for free rotational movement about its central axis relative to the support and thereby to the seat. As a result, the lifting element rotates when necessary to substantially reduce the likelihood of abrasive contact with the skin in instances where the legs of the user are shifted along the side of the seat and unintentionally engage the edge of the lifting element.

DETAILED DESCRIPTION OF THE DRAWINGS

Figure 1:
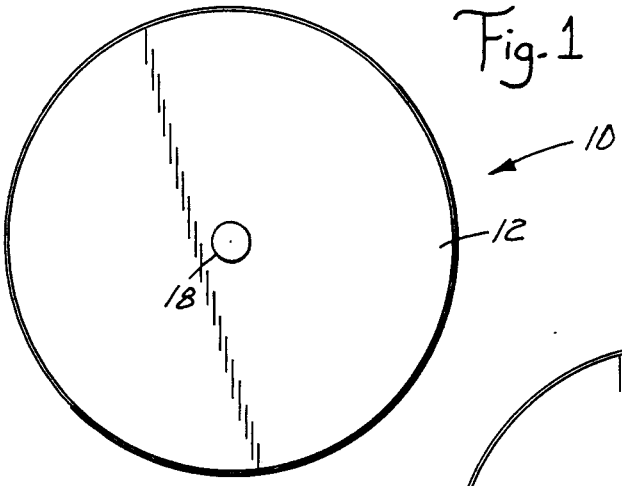
FIG. 1 represents a bottom view of a toilet seat lifting aid constructed in accordance with the principles of our present invention, illustrating a circular lifting element of the lifting aid.

A toilet seat lifting aid according to a preferred embodiment of our invention is designated broadly by the numeral 10 in FIGS. 1-4. The lifting aid 10 includes a flat lifting element 12 that is circular in plan view. As can be appreciated best by reference to FIG. 3, the lifting element 12 has a peripheral edge 14 that is smoothly rounded in vertical section.

The lifting aid 10 also includes a flat, circular support 16 of a diameter somewhat smaller than the diameter of the lifting element 12. The support 16 is pivotally interconnected to the lifting element 12 by means of a pin 18 which is preferably in the form of a rivet. The pin 18 extends through holes formed along a transverse, central axis of both of the support 16 and the lifting element 12, and the pin 18 presents on opposite ends a pair of enlarged heads which substantially prevent disassembly of the support 16 from the lifting element 12.

Figure 2:
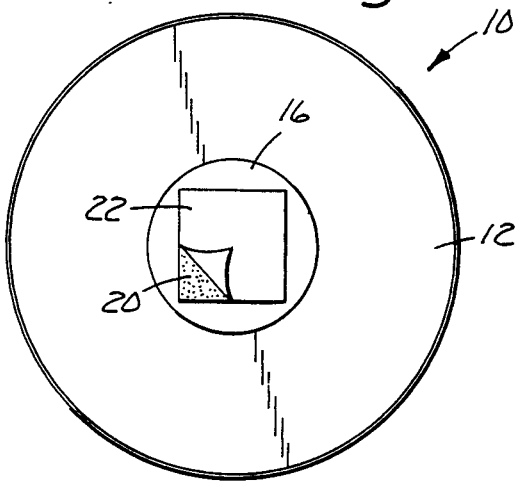
FIG. 2 is a plan view of the lifting aid shown in FIG. 1, depicting a support connected to the lifting element and a quantity of pressure-sensitive adhesive that is carried by the support and partially covered by a protective backing.
Figure 3:
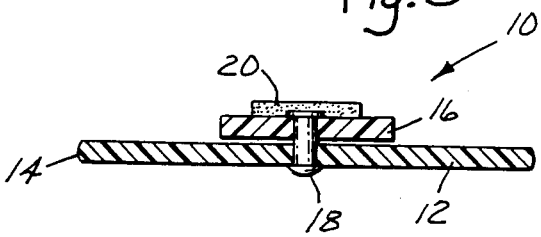
FIG. 3 is a side cross-sectional view of the lifting aid illustrated in FIGS. 1 and 2, showing among other things a pin that pivotally interconnects the lifting element and the support.

As illustrated in FIGS. 2 and 3, a quantity of pressure-sensitive adhesive 20 is carried on one flat side of the support 16 opposite from the side of the support 16 facing the lifting element 12. The adhesive 20 may optionally be in the form of a closed cell foam material which is provided, on opposite faces, with an adhesive substance resistant to water. As shown in FIG. 2, the adhesive 20 is initially protected before installation by a thin removable membrane or protective backing 22 which is depicted as partially peeled away from the adhesive 20 in FIG. 2 for illustrative purposes only.

Figure 4:
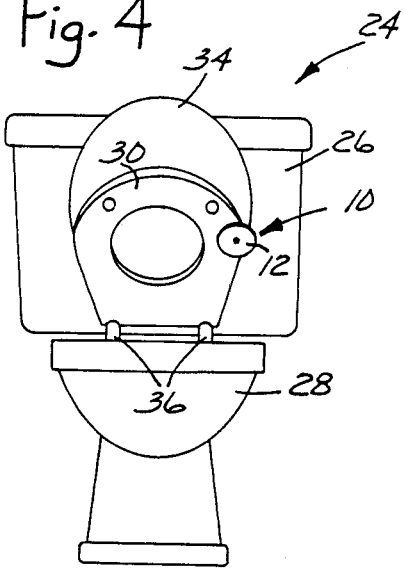
FIG. 4 is a reduced, front elevational view of a conventional toilet with a seat in a partially raised position, wherein the seat has been provided with a lifting aid of the present invention of the type shown in FIGS. 1-3.

The lifting aid 10 is shown in a position for use in FIG. 4 with an otherwise conventional water closet or toilet 24 that has a tank 26 and a bowl 28. A toilet seat 30 is pivotally connected to the bowl 28 by hinges 32 for movement about a horizontal axis between a lowered, generally horizontal use position and a raised or upright position resting against a lid 34.

The lifting aid 10 is secured to an underside, peripheral edge portion of the seat 30 preferably at a location approximately mid-way between the front and rear of the seat 30. During installation, the protective backing 22 is peeled away from the adhesive 20 in the manner shown in FIG. 2, and the adhesive 20 is then pressed in firm contact with the selected underside area of the seat 30. Thereafter, the moisture-resistant characteristics of the adhesive 20 firmly retain the lifting aid 10 in place until intentionally removed.

It can now be appreciated that the lifting aid 10 as shown in position for use in FIG. 4 on a partially raised seat extends outwardly from the seat 30 and from the toilet bowl 28 a distance sufficient for the user's hands to avoid all contact with the toilet 24 including the seat 30 and the bowl 28 whenever raising or lowering of the seat 30 is desired. The lifting element 12 and the support 16 are preferably comprised of long-lasting, synthetic resinous materials such as acrylic that are easy to maintain in a clean, sanitary condition. However, the lifting aid 10 is relatively inexpensive and can be easily replaced when desired.

Advantageously, the lifting element 12 rotates about pin 18 relative to the support 16 and around a generally vertical axis whenever accidentally brushed against by the sides of the legs of the user sitting atop the seat 30, so that the likelihood of injury to the skin or to the lifting aid 10 is substantially reduced. Moreover, the smoothly contoured edge 14 of the lifting element 12 further reduces the possibility of abrasive skin contact. When the lifting element is engaged by the legs, however, the resilient, cellular foam material comprising the adhesive 20 permits limited lateral deflection of the lifting aid 10 in horizontal or vertical directions to thereby enable the adhesive 20 to remain in firm attachment to the seat 30 without damage to the adhesive bond between seat 30 and support 16.

From the foregoing, it can now be understood that our present invention represents an effective solution to the problems and potential hazards of manual contact of the hands with unclean toilet seat surfaces. However, various modifications and additions to our currently preferred embodiment may readily come to mind to those skilled in the art. Consequently, the invention is to be deemed limited only by a fair scope of the claims which follow, along with their mechanical equivalents.

What is claimed is:

1. For use with a toilet seat having a front and back and having a bottom surface portion with an inner and outer periphery, said seat being movable between a horizontal position and a raised position, a lifting aid comprising:

a support;

adhesive means carried by said support for securing said support to the bottom surface portion of the toilet seat;

a generally flat lifting element; and means pivotally coupling said lifting element to said support for rotatable movement of said element relative to said support about a generally vertical axis passing through said flat element, near its center when said seat is in said horizontal position;

the relative dimensions of said adhesive means and said lifting element being such that when said adhesive means is attached between the inner and outer peripheries of said bottom surface a portion of said lifting element will protrude outwardly of said outer periphery to provide a seat lifting aid and such that when forces are exerted on the periphery of said lifting element along a front to back line of said seat said lifting element will tend to rotate about said axis.

2. The invention as set forth in claim 1, wherein said lifting element has rounded, peripheral edge portions.

3. The invention as set forth in claim 2, wherein said lifting element has a generally circular configuration.

4. The invention as set forth in claim 1, wherein said adhesive means includes means enabling limited lateral deflection of said support relative to said seat.

5. The invention as set forth in claim 4, wherein said adhesive means includes a cellular foam material.

* * * * *